US011472209B2

(12) United States Patent
Sumii

(10) Patent No.: US 11,472,209 B2
(45) Date of Patent: Oct. 18, 2022

(54) MEDIUM TRANSPORT APPARATUS AND RECORDING APPARATUS

(71) Applicant: SEIKO EPSON CORPORATION, Tokyo (JP)

(72) Inventor: Atsushi Sumii, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 197 days.

(21) Appl. No.: 16/842,361

(22) Filed: Apr. 7, 2020

(65) Prior Publication Data

US 2020/0324559 A1 Oct. 15, 2020

(30) Foreign Application Priority Data

Apr. 10, 2019 (JP) ..... JP2019-074635

(51) Int. Cl.

| | |
|---|---|
| ***B65H 5/06*** | (2006.01) |
| ***B65H 5/36*** | (2006.01) |
| ***B65H 3/52*** | (2006.01) |
| ***B41J 13/00*** | (2006.01) |
| ***B65H 29/12*** | (2006.01) |
| ***B41J 3/60*** | (2006.01) |
| ***B65H 85/00*** | (2006.01) |
| *B65H 5/38* | (2006.01) |

(52) U.S. Cl.

CPC ..... *B41J 13/009* (2013.01); *B41J 3/60* (2013.01); *B65H 3/52* (2013.01); *B65H 5/062* (2013.01); *B65H 5/36* (2013.01); *B65H 29/125* (2013.01); *B65H 85/00* (2013.01); *B65H 5/38* (2013.01); *B65H 2404/1431* (2013.01); *B65H 2404/1441* (2013.01); *B65H 2404/1442* (2013.01); *B65H 2404/54* (2013.01); *B65H 2801/06* (2013.01)

(58) Field of Classification Search

CPC ..... B41J 13/009; B41J 3/60; B65H 5/062; B65H 5/36; B65H 29/125; B65H 85/00; B65H 2404/1431; B65H 2404/1441; B65H 2404/1442; B65H 2404/54; B65H 2801/06; B65H 5/38; B65H 3/52

See application file for complete search history.

(56) References Cited

U.S. PATENT DOCUMENTS

2017/0313104 A1* 11/2017 Ogimura ..... B41J 13/0009

FOREIGN PATENT DOCUMENTS

| | | | | |
|---|---|---|---|---|
| JP | 2003054780 A | * | 2/2003 | ..... B65H 3/52 |
| JP | 3679652 B2 | * | 8/2005 | ..... B65H 3/52 |
| JP | 2017-196788 | | 11/2017 | |

* cited by examiner

*Primary Examiner* — Yaovi M Ameh
(74) *Attorney, Agent, or Firm* — Workman Nydegger

(57) ABSTRACT

A medium transport apparatus includes a first roller configured to apply feeding force to a medium in a medium transport path for transporting the medium, a second roller disposed on an upstream side of the first roller in a medium transport direction in the medium transport path, the second roller being configured to apply feeding force to the medium, a third roller configured to be switched between a first position at which the medium is to be nipped with the second roller and a second position at which the nipping of the medium is to be released, a switching section configured to switch a position of the third roller, and at least one protruding member protruding from an outer circumferential surface of the second roller, the protruding member being configured to separate the medium from the outer circumferential surface of the second roller in the medium transport path.

13 Claims, 11 Drawing Sheets

MEDIUM TRANSPORT APPARATUS AND RECORDING APPARATUS

The present application is based on, and claims priority from JP Application Serial Number 2019-074635, filed Apr. 10, 2019, the disclosure of which is hereby incorporated by reference herein in its entirety.

BACKGROUND

1. Technical Field

The present disclosure relates to a medium transport apparatus for transporting a medium and a recording apparatus having the medium transport apparatus.

2. Related Art

Recording apparatuses for discharging ink, which is example liquid, onto a sheet of medium such as ink jet printers are known. Some recording apparatuses perform recording on a first side of a medium by a recording unit, feed and reverse the recorded medium, and feed again the recorded medium to the recording zone of the recording unit to perform recording on a second side, which is an opposite side of the first side. JP-A-2017-196788 discusses an example of such reading apparatuses.

The recording apparatus described in JP-A-2017-196788 includes a driving roller that is driven to rotate to transport a medium, a plurality of driven rollers that contact with the medium at a position facing the driving roller, and a transport roller that is disposed on a downstream side of the driving roller in a transport path and is configured to nip the medium transported by the driving roller to transport the medium to a print zone. Among the driven rollers, the roller located most downstream in the transport path serves as a specific driven roller configured to be switched between a first position in which the specific driven roller comes into contact with the medium and a second position in which the specific driven roller cannot contact with the medium. After the medium has been nipped by the transport roller, the specific driven roller is controlled to be separated from the medium, and thereby the force applied from the specific driven roller to the medium is released, facilitating the stabilization of the orientation of the medium. In JP-A-2017-196788, the driving roller is referred to as a first roller, the driven roller is referred to as a second roller, and the transport roller is referred to as a third roller.

In the recording apparatus in JP-A-2017-196788, after the nipping of the medium by the transport roller, the specific driven roller is separated from the medium, and thereby adverse effects of the driving roller in transporting the medium by the transport roller can be reduced. However, the medium is still in contact with the driving roller and a transport load is produced, and this transport load may adversely affect the medium transport operation by the transport roller.

SUMMARY

According to an aspect of the present disclosure, a medium transport apparatus includes a first roller configured to apply feeding force to a medium in a medium transport path for transporting the medium, a second roller disposed on an upstream side of the first roller in a medium transport direction in the medium transport path, the second roller being configured to apply feeding force to the medium, a third roller configured to be switched between a first position at which the medium is to be nipped with the second roller and a second position at which the nipping of the medium is to be released, a switching section configured to switch a position of the third roller, and at least one protruding member protruding from an outer circumferential surface of the second roller, the protruding member being configured to separate the medium from the outer circumferential surface of the second roller in the medium transport path.

DESCRIPTION OF EXEMPLARY EMBODIMENTS

Figure 1:
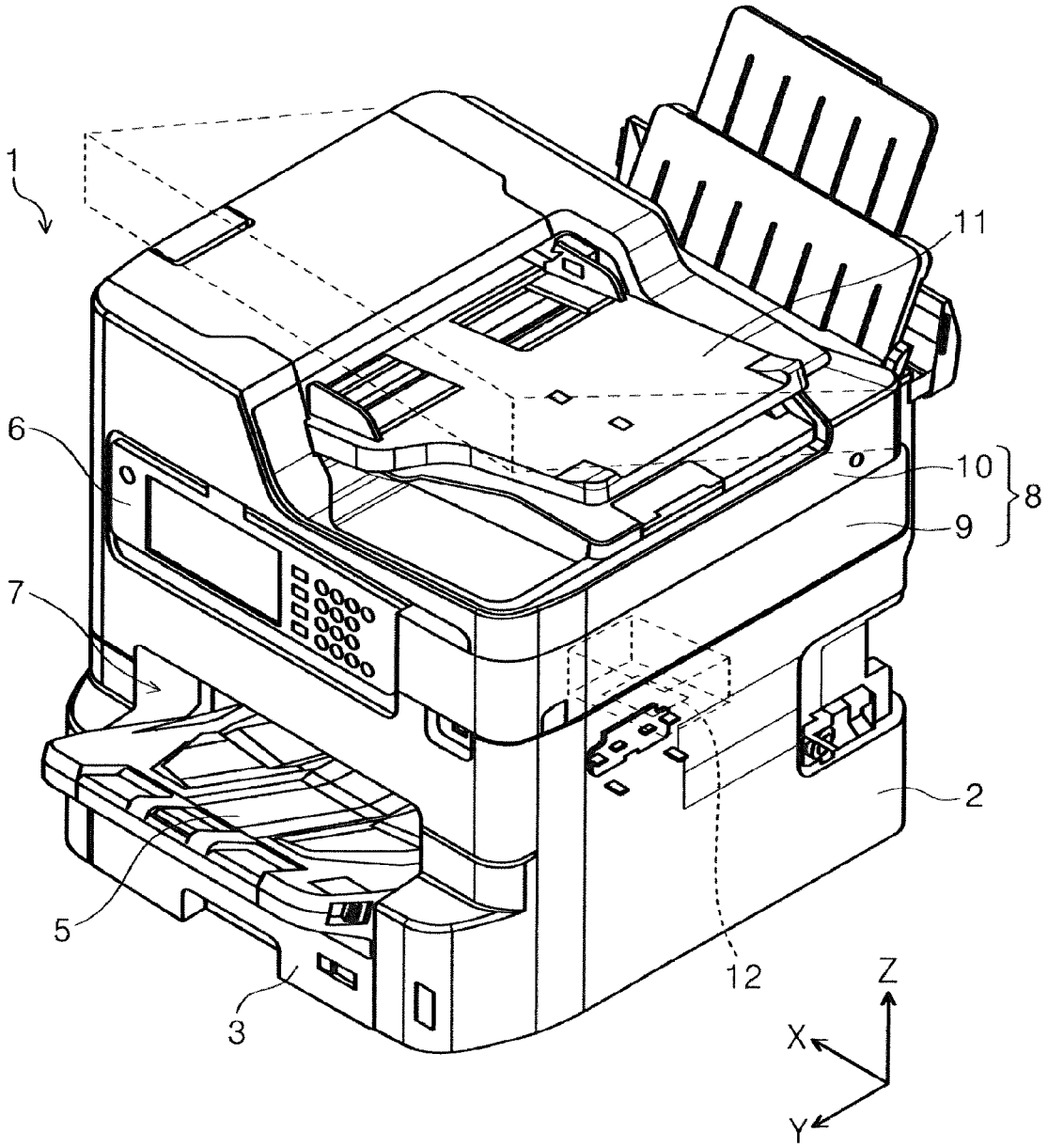
FIG. 1 is a perspective view of a multifunction peripheral viewed from the front.

Hereinafter, a brief overview of the present disclosure will be described. A medium transport apparatus according to an aspect includes a first roller configured to apply feeding force to a medium in a medium transport path for transporting the medium, a second roller disposed on an upstream side of the first roller in a medium transport direction in the medium transport path, the second roller being configured to apply feeding force to the medium, a third roller configured to be switched between a first position at which the medium is to be nipped with the second roller and a second position at which the nipping of the medium is to be released, a switching section configured to switch a position of the third roller, and at least one protruding member protruding from an outer circumferential surface of the second roller, the protruding member being configured to separate the medium from the outer circumferential surface of the second roller in the medium transport path.

According to this aspect, a medium transport apparatus includes at least one protruding member protruding from an outer circumferential surface of the second roller, the protruding member being configured to separate the medium from the outer circumferential surface of the second roller in the medium transport path. With this structure, the medium can be prevented from coming into contact with the second roller. Accordingly, in transporting the medium by the first roller, the adverse effect by the second roller can be prevented or reduced, and thus appropriate medium transport by the first roller can be provided. It is to be understood that in this specification, "protrusion" of the protruding member from the outer circumferential surface of the second roller means that in a side view of the medium transport path, at least a part of the protruding member is away from a rotation center of the second roller with respect to the outer circumferential surface of the second roller.

In a second aspect, in the first aspect, the protruding member may protrude from the outer circumferential surface of the second roller on an upstream side of the nip position at which the medium is nipped by the second roller and the third roller in the medium transport direction in the medium transport path.

In this aspect, in the structure in which the medium may contact with the outer circumferential surface of the second roller due to the structure of the medium transport path on the upstream side of the nip position in the medium transport direction, the functional effect in the first aspect can be achieved.

In a third aspect, in the first or second aspect, the protruding member may include a driven roller configured to contact with the transported medium and rotate, and an outer circumferential surface of the driven roller protrudes from the outer circumferential surface of the second roller.

In this aspect, the protruding member is a driven roller configured to contact with the transported medium and rotate, and an outer circumferential surface of the driven roller protrudes from the outer circumferential surface of the second roller. Accordingly, damages to the medium by the protruding member can be prevented or reduced and the transport load of the medium can be reduced.

In a fourth aspect, in any one of the first to third aspects, the at least one protruding member may comprise a plurality of protruding members disposed in a width direction that is a direction intersecting the medium transport direction. In this aspect, the at least one protruding member may comprise a plurality of protruding members disposed in a width direction that is a direction intersecting the medium transport direction. With this structure, the orientation of the medium in the width direction can be further stabilized.

In a fifth aspect, in the fourth aspect, at least some of the protruding members may be disposed on both sides of the second roller in the width direction. In this aspect, at least some of the protruding members are disposed on both sides of the second roller in the width direction, and thus the contact of the medium to the outer circumferential surface of the second roller can be more reliably prevented or reduced.

In a sixth aspect, in any one of the first to fifth aspects, the medium transport apparatus may include a fourth roller disposed on an upstream side of the second roller in the medium transport path, the fourth roller being configured to reverse the medium. In this aspect, in the structure including the fourth roller, any one of the effects in the above-described first to fifth aspects can be achieved.

In a seventh aspect, in the sixth aspect, the protruding member may protrude further from the second roller than a common tangent between an outer periphery of the second roller and an outer periphery of the fourth roller.

In a state in which the medium is on the second roller and the fourth roller, the medium approaches a common tangent between an outer periphery of the second roller and an outer periphery of the fourth roller and the medium tends to contact with the outer periphery of the second roller. In this aspect, the protruding member protrudes further from the second roller than a common tangent between an outer periphery of the second roller and an outer periphery of the fourth roller, and thus the contact of the medium to the outer periphery of the second roller can be prevented or reduced.

In an eighth aspect, in the first or second aspect, the protruding member may comprise a rib protruding from the outer circumferential surface of the second roller. In this aspect, the protruding member configured to a rib protruding from the outer circumferential surface of the second roller, and thus the protruding member can be provided in the simple structure at low cost.

In a ninth aspect, in any one of the first to eighth aspects, the protruding member may be switched between a forward position at which the protruding member protrudes from the outer circumferential surface of the second roller and a evacuation position at which the amount of protrusion of the second roller from the outer circumferential surface of the second roller is smaller than that at the forward position.

In this aspect, the protruding member is configured to be switched between a forward position at which the protruding member protrudes from the outer circumferential surface of the second roller and a evacuation position at which the amount of protrusion of the second roller from the outer circumferential surface of the second roller is smaller than that at the forward position. With this structure, in actively applying a feeding force to the medium by the second roller, the protruding member is switched to the evacuation position to ensure a contact region for the second roller and the medium, enabling the second roller to appropriately transport the medium. The expression "the amount of protrusion of the second roller from the outer circumferential surface of the second roller is smaller than that at the forward position" means that the protruding member may not protrude from the outer circumferential surface of the second roller, that is, the amount of protrusion may be zero.

In a tenth aspect, in the ninth aspect, the protruding member may be pressed in a direction protruding from the outer circumferential surface of the second roller, and the protruding member may be configured to be moved against the pressure in a direction the protrusion amount becomes small.

In this aspect, the protruding member is pressed in a direction protruding from the outer circumferential surface of the second roller, and the protruding member is configured to be moved against the pressure in a direction the protrusion amount becomes small. With this structure, when excessive tension is applied to the medium and the medium strongly presses against the protruding member, damages to the medium by the protruding member can be prevented or reduced.

In an eleventh aspect, in any one of the first to tenth aspects, the at least one protruding member may comprise a plurality of protruding members along the medium transport path. According to this aspect, the at least one protruding member comprises a plurality of protruding members along the medium transport path, and thus the contact of the medium to the second roller can be prevented or reduced over a wider range.

In a twelfth aspect, in any one of the first to eleventh aspects, the medium transport apparatus may further include a path forming member configured to form the medium transport path on an upstream side of the second roller, and the at least one protruding member may be configured to regulate the contact of the medium to the path forming member.

In this aspect, the medium transport apparatus further includes a path forming member configured to form the medium transport path on an upstream side of the second roller, and the at least one protruding member is configured to regulate the contact of the medium to the path forming member. With this structure, problems due to the contact of the medium to the path forming member can be prevented or reduced, and for example, damages or an increase in transport load can be prevented or reduced.

A recording apparatus according to a thirteenth aspect includes a recording section configured to perform recording onto a medium, and the medium transport apparatus configured to transport the medium to the recording section according to any one of the first to twelfth aspects. In this aspect, in the recording apparatus, effects similar to those in any one of the above-described first to twelfth aspects can be achieved.

Hereinafter, embodiments of the present disclosure will be described in detail. In the drawings, a direction along an X axis denotes an apparatus width direction. In the following description, when directions along the X axis, that is, a +X direction and a −X direction are not specifically mentioned, the directions may be collectively referred to as a "X-axis direction". A direction along a Y axis denotes an apparatus depth direction. A direction from the apparatus rear toward the apparatus front is referred to as a +Y direction, and a direction from the apparatus front toward the apparatus rear is referred to as a −Y direction. In the following description, when the directions along the Y axis, that is, the +Y direction and the −Y direction are not specifically mentioned, the directions may be collectively referred to as a "Y-axis direction". A direction along a Z axis denotes a vertical direction, and a +Z direction denotes vertically upward, and a −Z direction denotes vertically downward. In the following description, when the directions along the Z axis, that is, when the +Z direction and the −Z direction are not specifically mentioned, the directions may be collectively referred to as a "Z-axis direction". In this embodiment, a side surface on which an operation section 6 is provided among side surfaces of the apparatus is referred to as an apparatus front.

With reference to FIG. 1, an overall structure of a multifunction peripheral 1, which is an example recording apparatus, will be described. The multifunction peripheral 1 illustrated in FIG. 1 includes a recording unit 2, which is an apparatus main body, and a scanner unit 8 that is disposed on the recording unit 2. The multifunction peripheral 1 has both a recording function and an image reading function.

On an upper part of the front side of the multifunction peripheral 1 in FIG. 1, the operation section 6 is provided. The operation section 6 includes a display section such as a display panel. By using the operation section 6, a user can input an instruction to the multifunction peripheral 1 to perform recording in the recording unit 2 or an instruction to perform image reading operation in the scanner unit 8.

The recording unit 2 in the multifunction peripheral 1 includes a sheet storage cassette 3 for storing recording paper in a lower part. In the recording unit 2, a recording head 12 of a recording section is provided. Recording is performed by the recording head 12 onto a sheet of recording paper transported from the sheet storage cassette 3. The recorded recording paper is discharged from a discharge section 7 onto a discharge tray 5.

The scanner unit 8 includes a scanner body 9 that reads a document, and an automatic feeder 10 that can automatically feed documents placed on a paper feed tray 11 for reading of the documents. The automatic feeder 10 is disposed on the scanner body 9, and can be switched between a closed position indicated by the solid line in FIG. 1 and an open position indicated by the dotted line in FIG. 1. When the automatic feeder 10 is opened, a document positioning plate (not illustrated) on which a document is to be placed is exposed.

Figure 2:
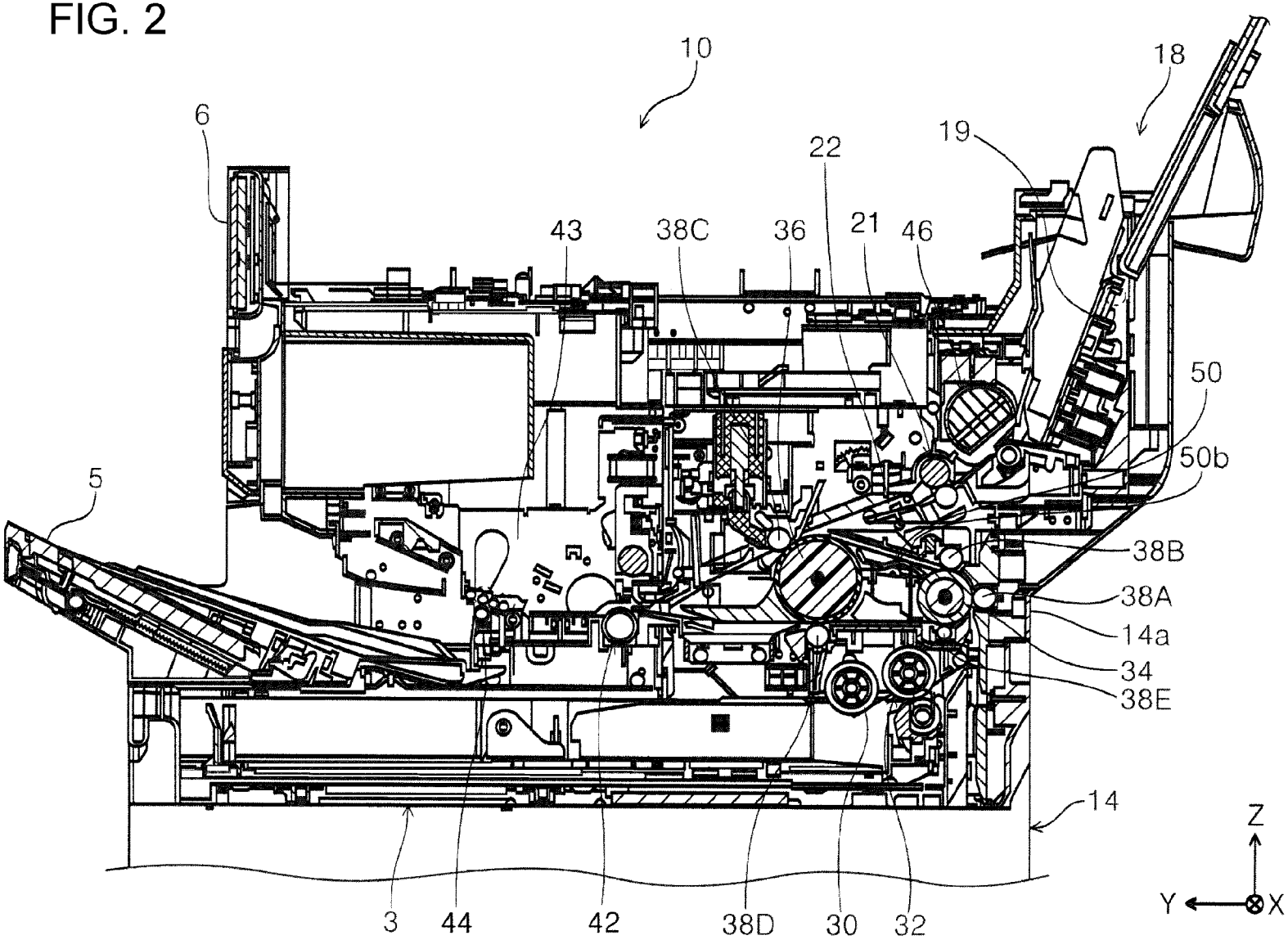
FIG. 2 is a side cross-sectional view illustrating a recording unit.
Figure 3:
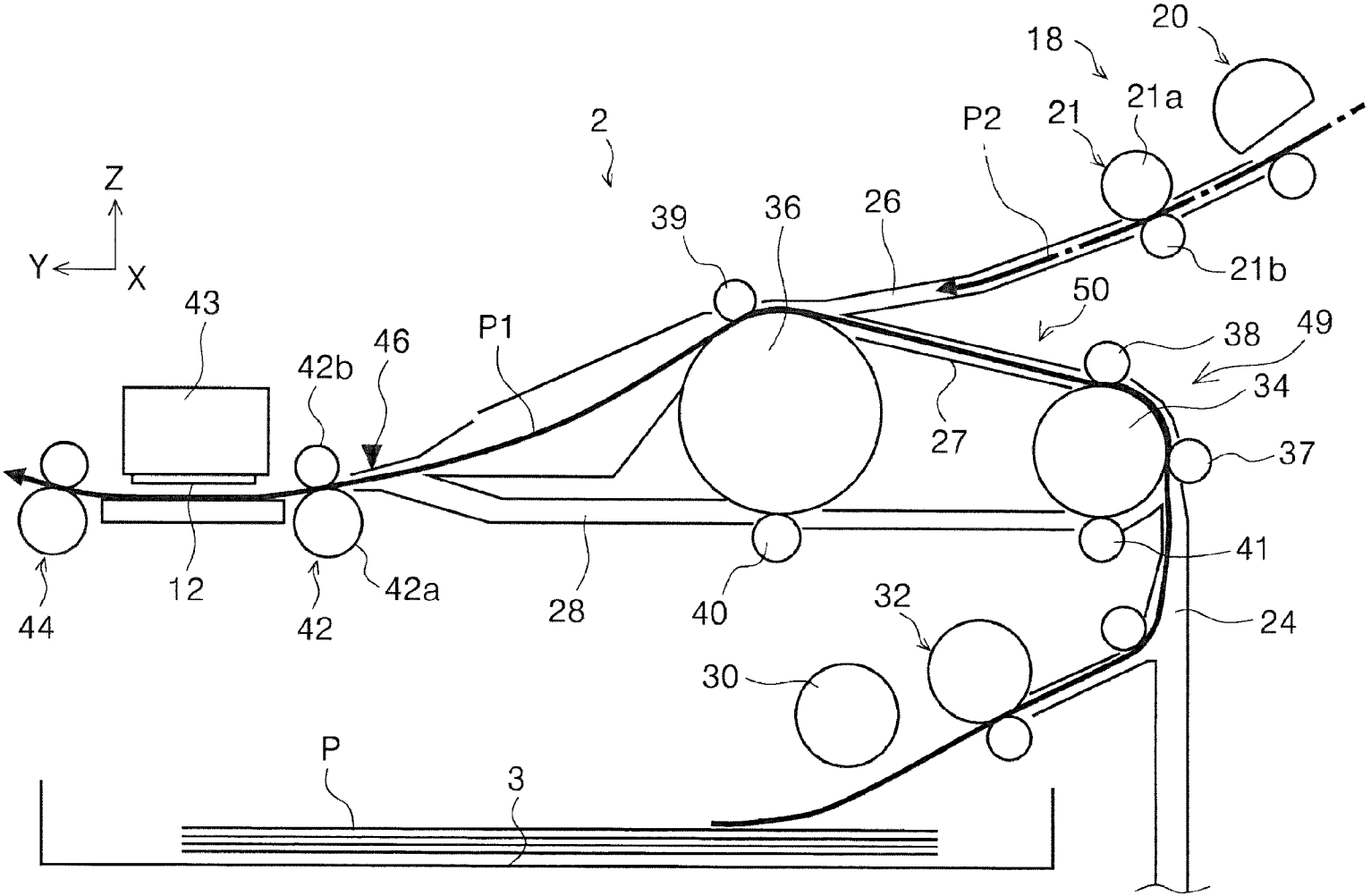
FIG. 3 schematically illustrates a sheet transport path in a recording unit.
Figure 4:
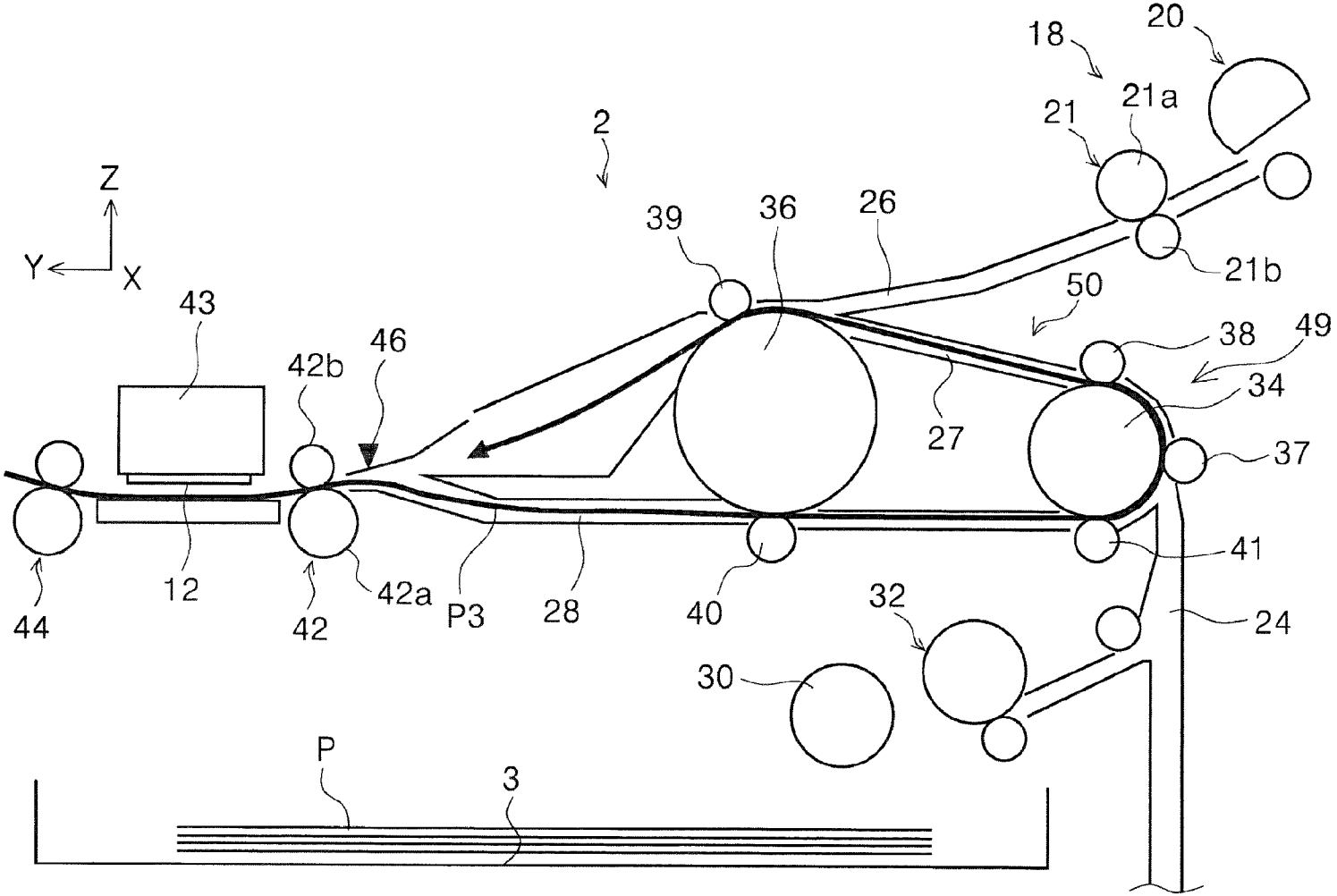
FIG. 4 schematically illustrates a sheet transport path in a recording unit.

With reference to FIG. 2 to FIG. 4, sheet transport paths in the recording unit 2 for performing recording onto paper, which is an example medium, will be described. In FIG. 2 to FIG. 4, for the sake of simplicity, a first protruding roller 52 and a second protruding roller 53, which will be described below, are omitted. The recording unit 2 includes a sheet feeding path 24, a sheet feeding path 26, a sheet transport path 27, and a reversing path 28 as illustrated in FIG. 3 and FIG. 4. Among the sheet feeding paths, the sheet feeding path 24 according to the embodiment is a sheet transport path from the sheet storage section 3 to a first driven roller 37. The sheet feeding path 26 according to the embodiment is a sheet feeding path from a supporting member 19 illustrated in FIG. 2 to a third driven roller 39. The sheet transport path 27 according to the embodiment is a sheet transport path from the first driven roller 37 via a second driven roller 38, the third driven roller 39, and a transport roller pair 42 to a discharging roller pair 44. The reversing path 28 is a sheet transport path from the transport roller pair 42 via a fourth driven roller 40 and a fifth driven roller 41 to the first driven roller 37. The recording unit 2 includes a sheet transport device 49. The sheet transport device 49 includes components of the sheet transport path 27. Specifically, the sheet transport device 49 includes a unit body 50, which will be described below, the third transport driven roller 39, and the transport roller pair 42. It is to be understood that a structure of the recording unit 2 from which a recording function such as the recording head 12 is omitted may be regarded as the sheet transport device 49, or in the view of the sheet transport, the recording unit 2 itself may be regarded as the sheet transport device 49.

The sheet feeding path 24 is a path for feeding a paper sheet from the sheet storage cassette 3 toward a reversing roller 34, which is a fourth roller. The paper sheets stored in the sheet storage cassette 3 is fed downstream by a feeding roller 30 and a transport roller pair 32 along the sheet feeding path 24. Paper sheets P are stored in the sheet storage cassette 3. On a downstream side of the transport roller pair 32, the reversing roller 34 is disposed, and with respect to the reversing roller 34, a feeding roller 36, which is a second roller, is disposed with a space in the +Y direction. In this embodiment, the feeding roller 34 is smaller than the feeding roller 36 in diameter. In this embodiment, a position of a rotation center of the reversing roller 34 in the Z-axis direction is the same as a part of the feeding roller 36 in height. More specifically, in the Z-axis direction, a lowest position of the outer circumferential surface of the reversing roller 34 is the same as a lowest position of the outer circumferential surface of the feeding roller 36 in height. The reversing roller 34 and the feeding roller 36 are components of the unit body 50, which will be described below.

Around the reversing roller 34, the first driven roller 37, the second driven roller 38, and the fifth driven roller 41 to be rotated by the reversing roller 34 are disposed. Around the feeding roller 36, the third driven roller 39, which serves as a third roller, and the fourth driven roller 40 to be rotated by the feeding roller 36 are disposed. Among the driven rollers, the second driven roller 38 is a component of the unit body 50, which will be described below.

A paper sheet fed downstream in the transport direction by the transport roller pair 32 is nipped in sequence by the reversing roller 34 and the first driven roller 37, the reversing roller 34 and the second driven roller 38, and the feeding roller 36 and the third driven roller 39 toward downstream in the transport direction.

On the downstream side of the feeding roller 36 in the transport direction, the transport roller pair 42 is disposed. The transport roller pair 42 includes a driving roller 42*a*, which serves as a first roller, and a driven roller 42*b*. The driving roller 42*a* is driven by a motor (not illustrated) and the driven roller 42*b* is rotated by the driving roller 42*a*. The driving roller 42*a* has, for example, a high-friction layer of particles adhered to the surface of a metal shaft. The driven roller 42*b* is made of a resin material, for example, polyoxymethylene (POM). The driven roller 42*b* can move toward or away from the driving roller 42*a* and is pressed by a pressing unit (not illustrated), for example, a spring, against the driving roller 42*a*. A sheet feeding force by the transport roller pair 42 is larger than that by the feeding roller 36.

On the downstream side of the transport roller pair 42, a carriage 43 having the recording head 12 is disposed. In this embodiment, the carriage 43 can reciprocate in the X-axis direction. The recording head 12 is disposed on a lower part of the carriage 43 to discharge ink, which is an example liquid, toward a paper sheet.

On the downstream side of the carriage 43 in the transport direction, the discharging roller pair 44 is disposed. The discharging roller pair 44 discharges a paper sheet on which recording has been performed by the recording head 12 toward the discharge tray 5. The bold solid line P1 in FIG. 3 indicates a path on which a paper sheet is fed via the sheet feeding path 24 and transported via the sheet transport path 27, recording is performed on the paper sheet, and the recorded paper sheet is discharged.

Next, the sheet feeding path 26 will be described. The sheet feeding path 26 is a path from a sheet feeding section 18 disposed on the rear side of the apparatus toward the feeding roller 36. As illustrated in FIG. 2, the sheet feeding section 18 includes the supporting member 19, a feeding roller 20, and a feeding roller pair 21. On the supporting member 19, paper sheets can be mounted in a tilted state. The feeding roller 20 feeds paper sheets supported by the supporting member 19. The feeding roller pair 21 is disposed on the downstream side of the feeding roller 20. The feeding roller pair 21 includes a driving roller 21*a* (see FIG. 3) that is driven by a motor (not illustrated) and a driven roller 21*b* (see FIG. 3) that nips a paper sheet with the driving roller 21*a* therebetween.

In this embodiment, the sheet feeding path 26 merges with the sheet transport path 27 at a position on the upstream side of the nip position in the transport direction between the feeding roller 36 and the third driven roller 39. The alternate long and short dashed lines P2 in FIG. 3 indicates a path on which a paper sheet is fed via the sheet feeding path 26, recording is performed on the paper sheet, and the recorded paper sheet is discharged.

With reference to FIG. 4, the reversing path 28 will be described. In this embodiment, the reversing path 28 is configured to reverse a first side (front side) and a second side (back side) of a paper sheet. Specifically, after recording onto the first side of a paper sheet has completed, the transport roller pair 42 is reversely rotated, and the paper sheet is fed toward the nip point between the feeding roller 36 and the fourth driven roller 40.

The paper sheet that has passed through the nip point between the feeding roller 36 and the fourth driven roller 40 is fed downstream in the transport direction while the paper sheet is being nipped around the reversing roller 34 in sequence with the fifth driven roller 41, the first driven roller 37, and the second driven roller 38. The paper sheet transported around the reversing roller 34 is reversed from the first side (front side) to the second side (back side).

The paper sheet that has passed through the second driven roller 38 is nipped by the feeding roller 36 and the third driven roller 39 and fed again to the transport roller pair 42. The transport roller pair 42 feeds the paper sheet into an area facing the recording head 12 with the second side facing up. The recording head 12 discharges ink toward the second side of the paper sheet for recording. The paper sheet on which recording has been performed on the second side is discharged by the discharging roller pair 44 toward the discharge tray 5. The solid line P3 in FIG. 4 indicates a passage path on which a paper sheet is reversed along the reversing path 28.

Figure 5:
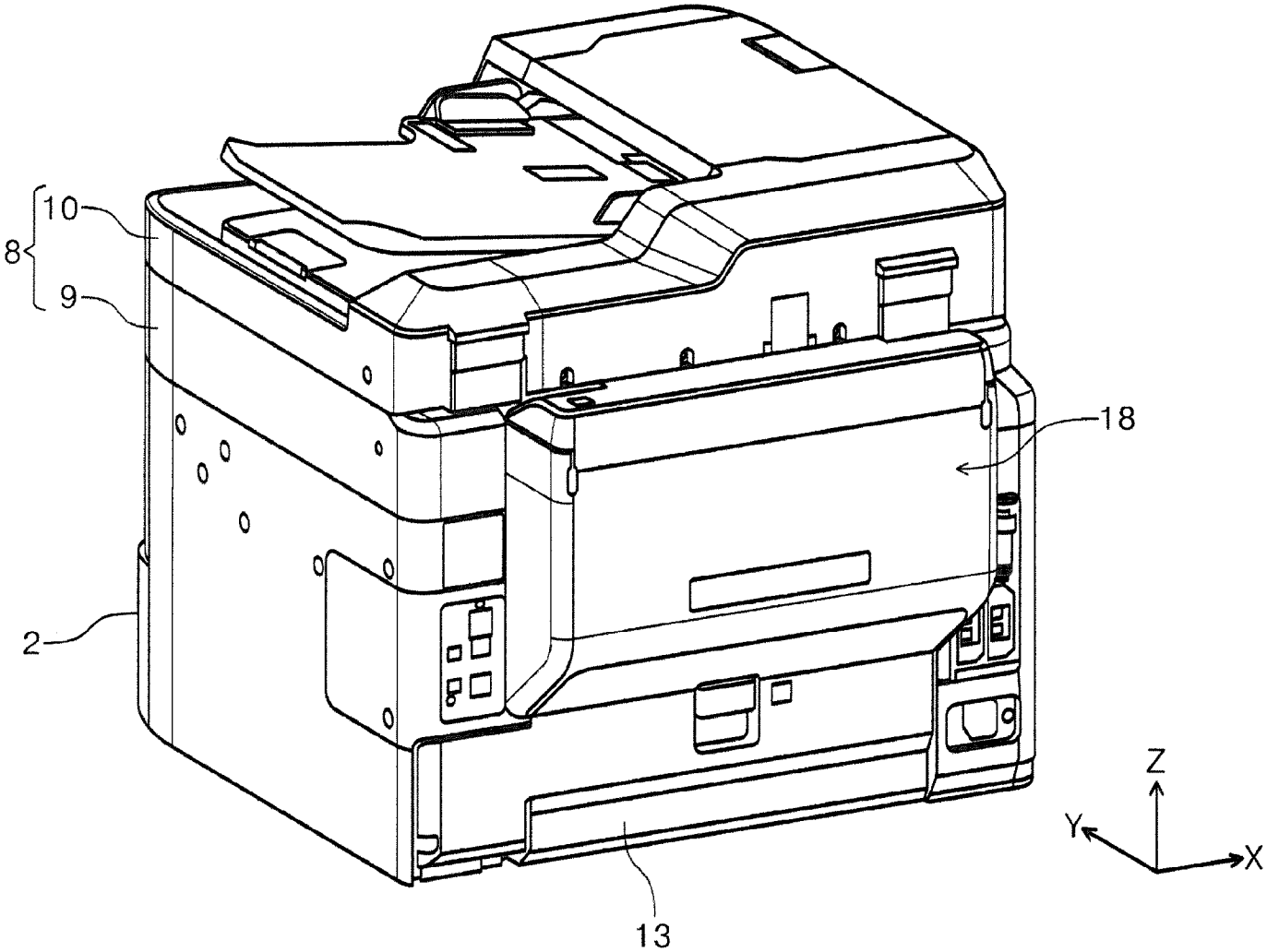
FIG. 5 is a perspective view of a multifunction peripheral viewed from the rear in which a cover is completely closed.
Figure 6:
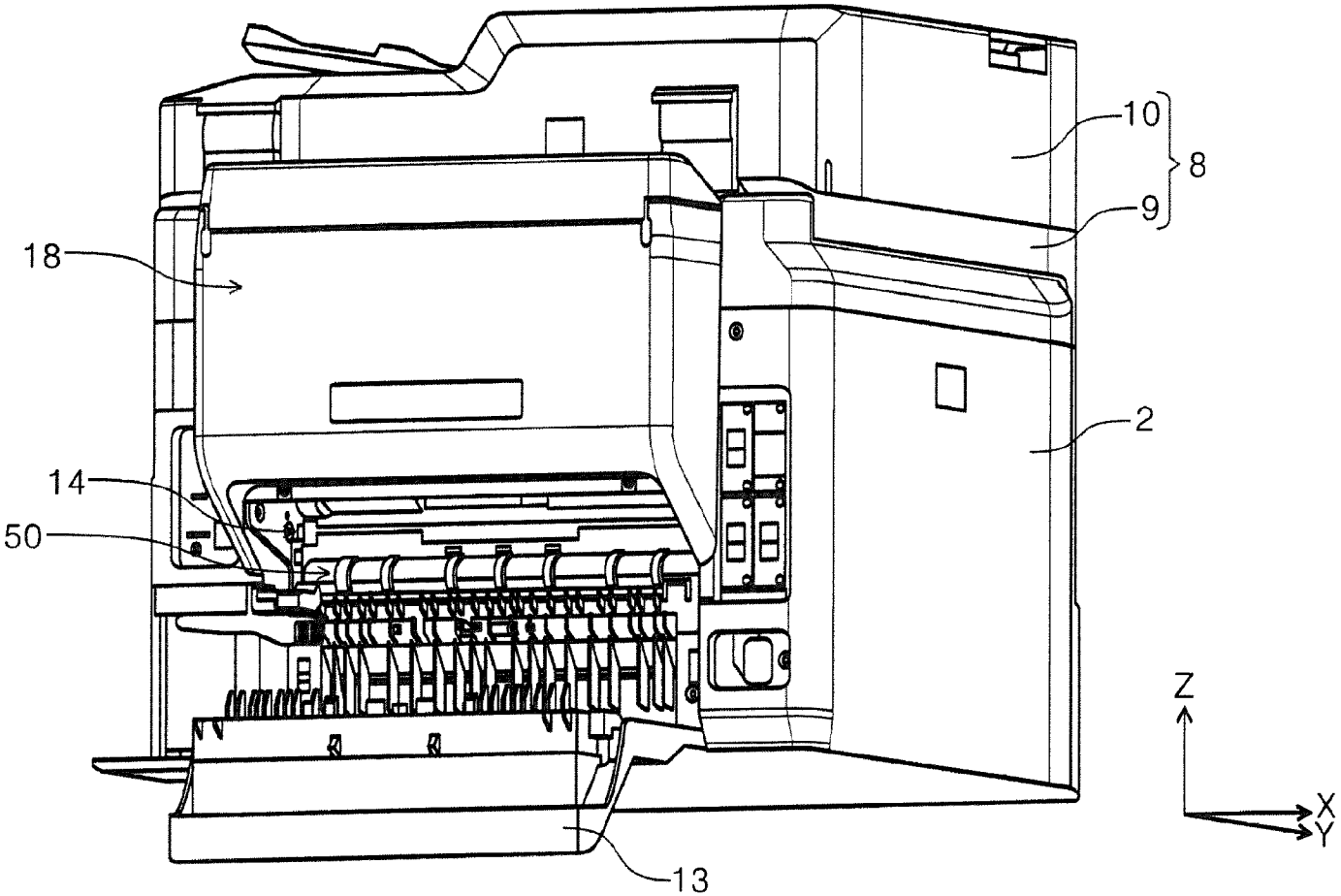
FIG. 6 is a perspective view of a multifunction peripheral viewed from the rear in which a cover is completely opened.

With reference to FIG. 5 and subsequent drawings, the unit body 50 will be described. On the rear side of the recording unit 2, a cover 13 that is an openable and closable opening/closing body is disposed. The cover 13 can swing about a pivot shaft (not illustrated) and maintain a closed state (FIG. 5) by a locking mechanism (not illustrated). When the cover 13 is open with respect to the recording unit 2, as illustrated in FIG. 6, an attachment section 14 in the recording unit 2 is exposed, and a user can attach or detach the unit body 50.

Figure 7:
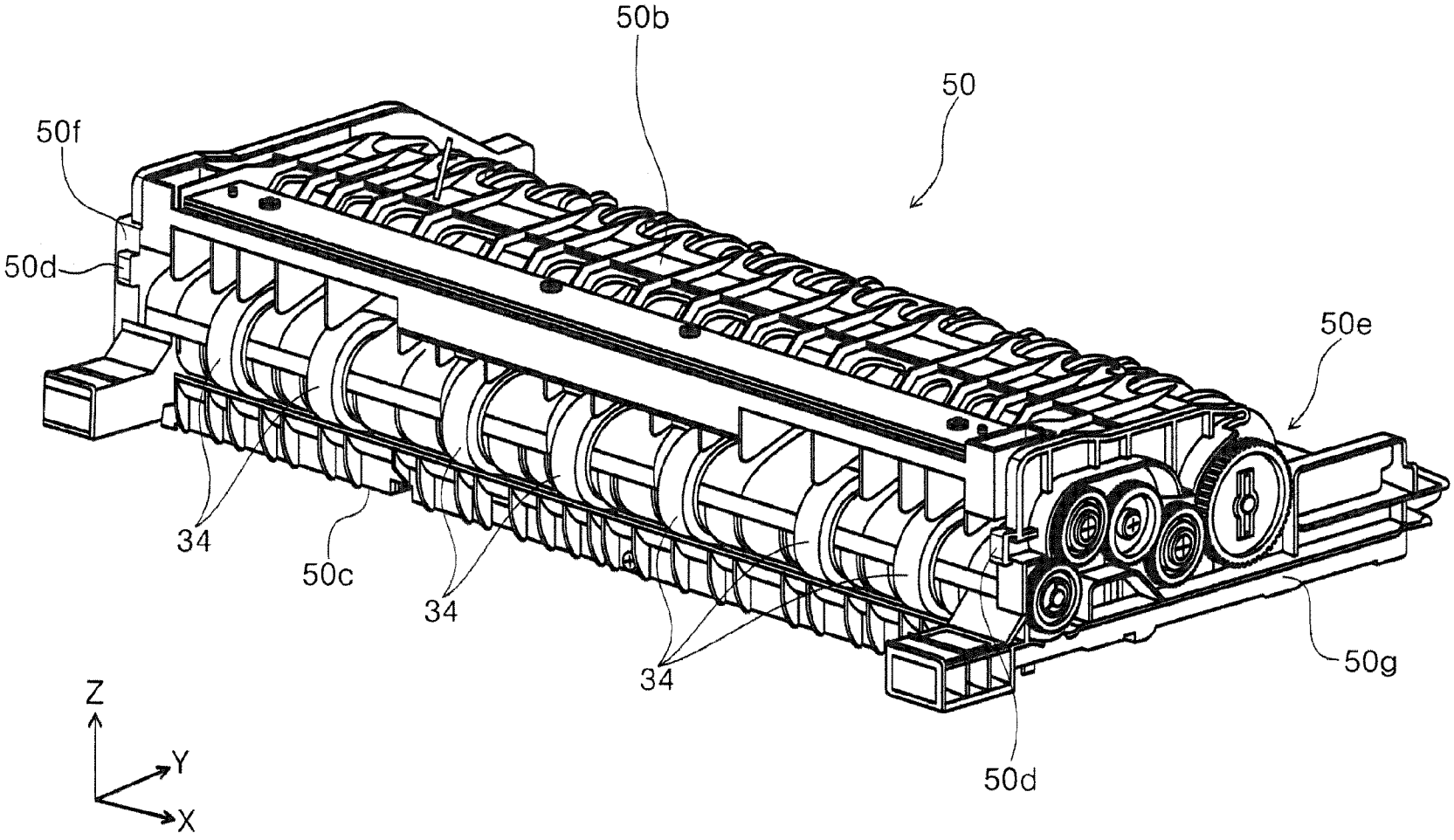
FIG. 7 is a perspective view of a unit body viewed from the rear.
Figure 8:
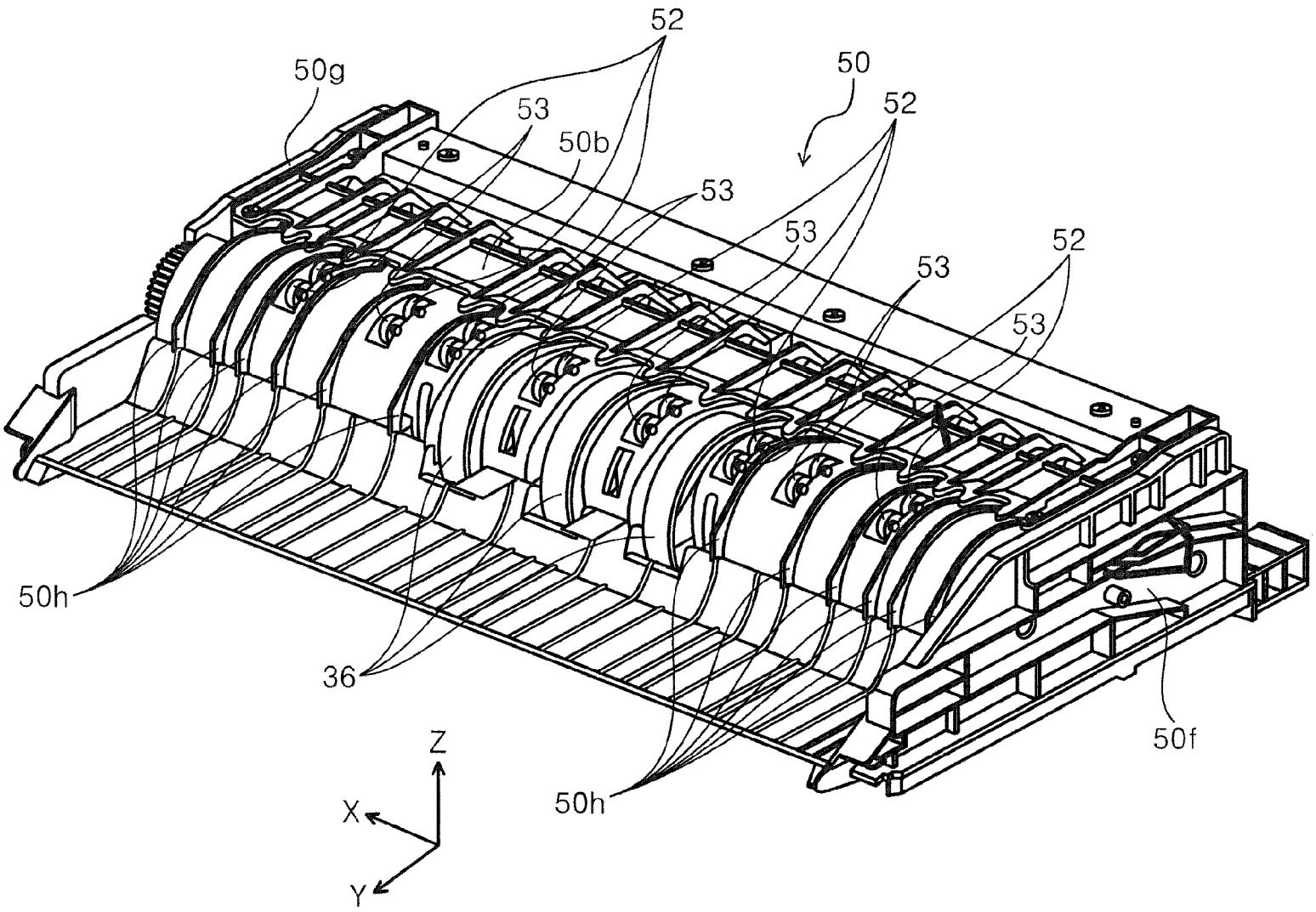
FIG. 8 is a perspective view of a unit body viewed from the front.

In this embodiment, the unit body 50 includes the reversing rollers 34, the feeding rollers 36, and the second driven roller 38. The unit body 50 is attached to the attachment section 14 of the recording unit 2 and thereby the reversing path 28 is formed. When the unit body 50 is detached from the attachment section 14, the reversing path 28 is exposed and then, jam processing can be performed for a paper jam that has occurred in the reversing path 28. In this embodiment, a plurality of the reversing rollers 34 and the feeding rollers 36 are disposed at appropriate intervals in the X-axis direction. In this embodiment, the reversing rollers 34 are disposed along the X-axis direction as illustrated in FIG. 7, and the feeding rollers 36 are disposed only in a central region in the X-axis direction as illustrated in FIG. 8. The reversing rollers 34 may be disposed only in the central region in the X-axis direction similarly to the feeding rollers 36, or the feeding rollers 36 may be disposed along the X-axis direction similarly to the reversing rollers 34. Furthermore, only one reversing roller 34 and only one feeding roller 36 may be disposed in the X-axis direction, for example, in the central region in the X-axis direction.

As illustrated in FIG. 7 and FIG. 8, the unit body 50 includes an upper path forming member 50*b*, a lower path forming member 50*c*, and side frame sections 50*f* and 50*g*. The side frame section 50*g* has a drive transmission section 50*e*, and when the unit body 50 is attached to the attachment section 14, driving force is transmitted from a motor (not illustrated) in the recording unit 2 via the drive transmission section 50*e* to the reversing rollers 34 and the feeding rollers 36.

The side frame sections 50*f* and 50*g* have contact portions 50*d* in the −Y direction. When the unit body 50 is attached to the attachment section 14 and the cover 13 is closed, the contact portions 50*d* are pressed by the cover 13 in the +Y direction to position the unit body 50 to an attachment position.

Figure 9:
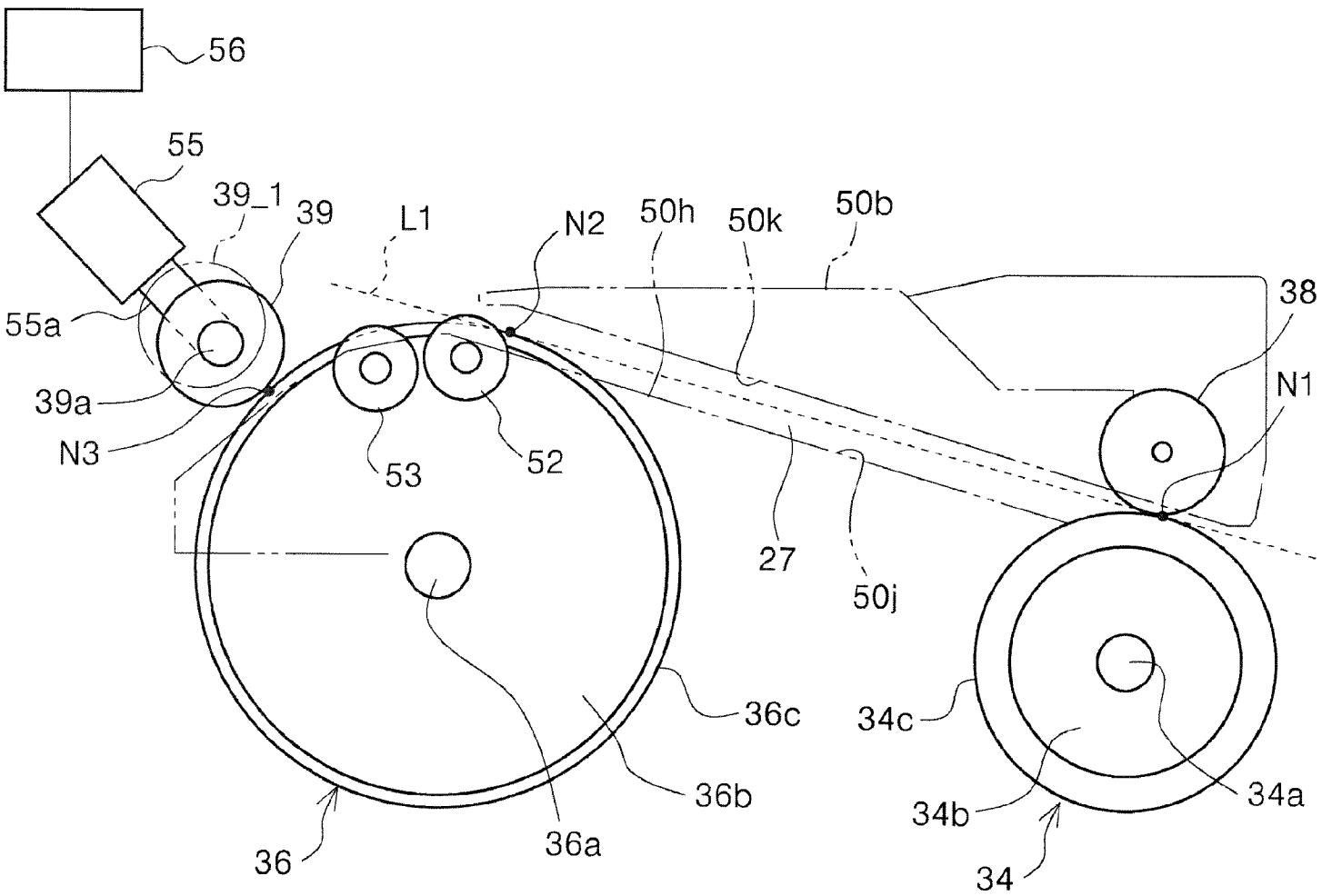
FIG. 9 is an enlarged view illustrating a part of a sheet transport path.

A lower side of the upper path forming member 50*b* serves as a first path forming surface 50*k* that defines the sheet transport path 27 as illustrated in FIG. 9, and at positions facing the first path forming surface 50*k*, ribs 50*h* that define a second path forming surface 50*j* are disposed.

In the sheet transport path 27, a path portion between the reversing roller 34 and the feeding roller 36 is defined by the first path forming surface 50*k* and the second path forming surface 50*j*. Each rib 50*h* extends from the downstream side of the reversing roller 34 toward the vicinity of the downstream side of a nip position N3 between the feeding roller 36 and the third driven roller 39. The rib 50*h* extends so as not to protrude over the outer circumferential surface of the feeding roller 36. The ribs 50*h* are disposed along the X-axis direction at appropriate intervals as illustrated in FIG. 8.

Next, with reference to FIG. 8 and subsequent drawings, the first protruding roller 52 and the second protruding roller 53 as "protruding members" will be described. As described above, the recording unit 2 includes the driving roller 42*a*, which applies feeding force to a paper sheet in the sheet transport path 27, the feeding roller 36, which is disposed on the upstream side of the driving roller 42*a* in the sheet transport direction in the sheet transport path 27 to apply feeding force to a paper sheet, and the third driven roller 39 that can nip a paper sheet with the feeding roller 36 therebetween. The third driven roller 39 can be switched between a first position at which a paper sheet can be nipped between the third driven roller 39 and the feeding roller 36 and a second position at which the nipping of a paper sheet between the third driven roller 39 and the feeding roller 36 can be released. In FIG. 9, the solid line 39 denotes the third driven roller in the first position, and the chain double-dashed line 39_1 denotes the third driven roller in the second position. The recording unit 2 includes a solenoid 55 that serves as a switching section for switching a position of the third driven roller 39.

A rotation shaft 39*a* of the third driven roller 39 is supported by a plunger 55*a* of the solenoid 55. The third driven roller 39 is switched between the first position and the second position as the plunger 55*a* moves forward and backward in response to the power on and off of the solenoid 55. A controller 56 is used to power on or off the solenoid 55. The controller 56 switches the third driven roller 39 in accordance with a detection signal from a sheet detection sensor 46 (see FIG. 3 and FIG. 4) that is disposed in the vicinity of the upstream side of the transport roller pair 42 in the sheet transport path 27. When the controller 56 determines that a leading edge of a paper sheet has not reached the transport roller pair 42, the controller 56 performs control to position the third driven roller 39 to the first position and when determining that a leading edge of a paper sheet has reached the transport roller pair 42, the controller 56 performs control to switch the third driven roller 39 from the first position to the second position. When a trailing edge of a paper sheet passes through the position of the sheet detection sensor 46 (see FIG. 3 and FIG. 4), the controller 56 switches the third driven roller 39 from the second position to the first position.

By such control, in transporting the paper sheet by using the transport roller pair 42, the feeding roller 36 can be prevented from producing a transport load. In this embodiment, in transporting an A4-size paper along a longitudinal direction, when a leading edge of the paper sheet is positioned at a recording start position, a trailing edge of the paper sheet is positioned between the reversing rollers 34 and the feeding rollers 36. From the state, a recording operation by the recording head 12 and a sheet feeding operation by the transport roller pair 42 are alternately performed to perform recording onto the paper sheet. In this processing, in synchronization with the rotation of the transport roller pair 42, the feeding rollers 36 and the reversing rollers 34 rotate.

If an error occurs in the paper-feed speed by the feeding roller 36 and the paper-feed speed by the feeding roller 36 becomes lower than the paper-feed speed by the transport roller pair 42, the paper sheet is pulled between the feeding roller 36 and the transport roller pair 42, that is, back tension is produced, and the paper feed accuracy by the transport roller pair 42 may be adversely affected.

Figure 10:
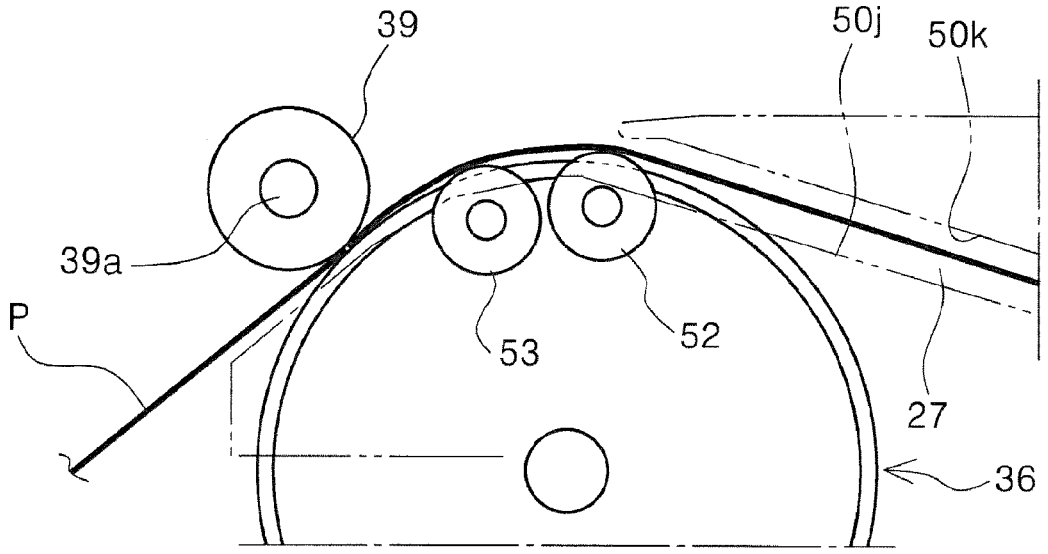
FIG. 10 is an enlarged view illustrating a part of a sheet transport path.
Figure 11:
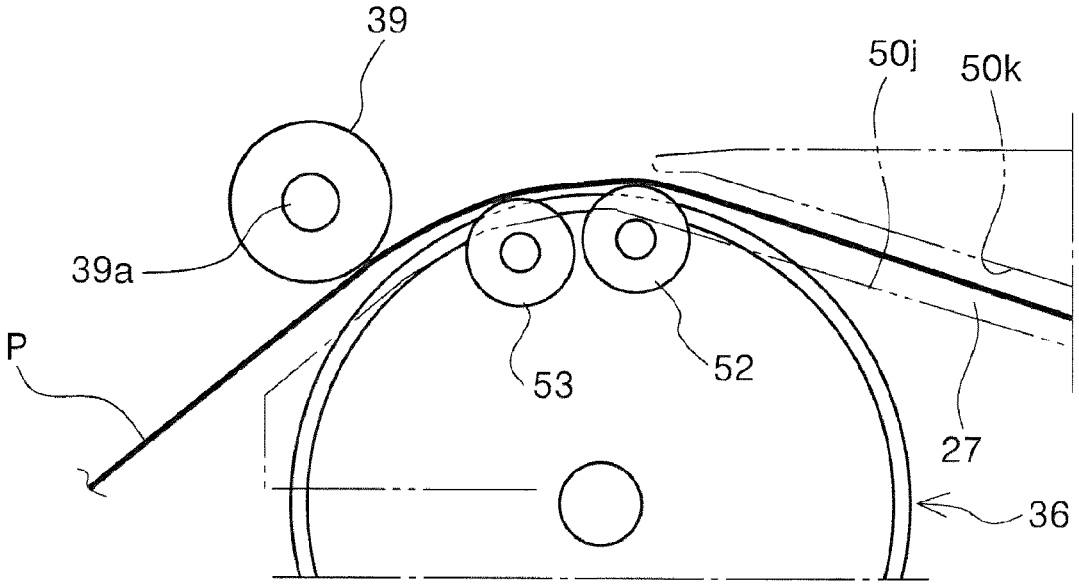
FIG. 11 is an enlarged view illustrating a part of a sheet transport path.

This problem can be basically solved with the above-described structure; the third driven roller 39 can be switched between the first position at which a paper sheet can be nipped between the third driven roller 39 and the feeding roller 36 as illustrated in FIG. 10 and the second position at which the nipping of the paper sheet between the third driven roller 39 and the feeding roller 36 can be released as illustrated in FIG. 11. Accordingly, when the third driven roller 39 is in the second position, the back tension caused by the contact between the feeding roller 36 and the paper sheet in the paper feeding by the transport roller pair 42 can be prevented or reduced. In FIG. 10 and FIG. 11, a paper sheet P is illustrated. In this structure, however, there is still a possibility that the paper sheet comes into contact with the outer circumferential surface of the feeding roller 36 and the paper sheet comes into contact with the feeding roller 36, and then, back tension will occur and the back tension may adversely affect the paper feeding by the transport roller pair 42.

To solve the problem, in this embodiment, in order to reduce the effect by the above-described back tension, in the unit body 50, the first protruding roller 52 and the second protruding roller 53 as the protruding members are disposed. The first protruding roller 52 and the second protruding roller 53 protrude from the outer circumferential surface of the feeding roller 36 to separate a paper sheet from the outer circumferential surface of the feeding roller 36 at least at the protruding positions in the sheet transport path 27. With this structure, a paper sheet can be prevented from coming into contact with the feeding roller 36 as illustrated in FIG. 11, further reducing the adverse effect by the feeding roller 36 in transporting the paper sheet by the transport roller pair 42, providing further appropriate paper transport by the transport roller pair 42.

In particular, in this embodiment, the first protruding roller 52 and the second protruding roller 53 as the protruding members are disposed at a bend path portion in the sheet transport path 27. In the bend path portion, a paper sheet can readily contact with the outer circumferential surface of the feeding roller 36, however, the first protruding roller 52 and the second protruding roller 53 can appropriately prevent the paper sheet from coming into contact with the outer circumferential surface of the feeding roller 36. The first protruding roller 52 and the second protruding roller 53 as the protruding members separate a paper sheet from the outer circumferential surface of the feeding roller 36 at least at the positions protruding from the outer circumferential surface of the feeding roller 36 in the sheet transport path 27. The sheet separation range in the sheet transport direction becomes wide as the protrusion amount of the protruding members is increased and becomes narrow as the protrusion amount is decreased.

In this embodiment, on the upstream side of the feeding roller 36, the rib 50*h* is disposed as the path forming member. Of the first protruding roller 52 and the second protruding roller 53, in particular, the second protruding roller 53 prevents a paper sheet from coming into contact with the rib 50*h*, and accordingly, damages or an increase in transport load due to a paper sheet coming into contact with the rib 50*h* can be prevented or reduced.

In this embodiment, the first protruding roller 52 and the second protruding roller 53 are driven rollers that are rotated by contacting with a paper sheet being transported, and the outer circumferential surfaces of the driven rollers protrude from the outer circumferential surface of the feeding roller 36. Accordingly, damages to the paper sheet can be prevented or reduced and the transport load can be reduced.

In this embodiment, the protruding members, that is, the first protruding roller 52 and the second protruding roller 53 are disposed along the sheet transport path 27, and thus the contact of a paper sheet with the feeding roller 36 can be prevented or reduced over a wider range.

In this embodiment, the first protruding roller 52 and the second protruding roller 53 protrude from the outer circumferential surface of the feeding roller 36 on the upstream side of the nip position N3 at which a paper sheet is to be nipped by the feeding roller 36 and the third driven roller 39 in the sheet transport direction in the sheet transport path 27.

In this embodiment, of the first protruding roller 52 and the second protruding roller 53, the first protruding roller 52 protrudes further from the feeding roller 36 than a common tangent L1 between the outer periphery of the feeding roller 36 and the outer periphery of the reversing roller 34. With this structure, the following operational effects can be achieved. In a state in which a paper sheet is on the feeding roller 36 and the reversing roller 34, the paper sheet approaches the common tangent L1 between the outer periphery of the feeding roller 36 and the outer periphery of the reversing roller 34, and the paper sheet tends to contact with the feeding roller 36. The first protruding roller 52, however, as described above, protrudes from the feeding roller 36 than the common tangent L1 between the outer periphery of the feeding roller 36 and the outer periphery of the reversing roller 34, and thus the first protruding roller 52 can prevent or reduce the contact of a paper sheet with the feeding roller 36.

In this embodiment, a plurality of the first protruding rollers 52 and a plurality of the second protruding rollers 53 are disposed in the width direction that is a direction intersecting the sheet transport direction as illustrated in FIG. 8. With this structure, the orientation of a paper sheet in the width direction can be further stabilized.

Furthermore, the first protruding rollers 52 and the second protruding rollers 53 disposed in the width direction are disposed to sandwich the feeding rollers 36 in the width direction as illustrated in FIG. 8. With this structure, the contact of a paper sheet with the feeding rollers 36 can be more reliably prevented or reduced. In this embodiment, the feeding rollers 36 are disposed in the width direction at intervals, and on both sides of each feeding roller 36, the first protruding roller 52 and the second protruding roller 53 are disposed.

The first protruding rollers 52 and the second protruding rollers 53 may be switched between a forward position at which the first protruding rollers 52 and the second protruding rollers 53 protrude from the outer circumferential surfaces of the feeding rollers 36 and a evacuation position at which the amount of protrusion of the feeding rollers 36 from the outer circumferential surfaces is small. At the evacuation position, the outer circumferential surfaces of the first protruding rollers 52 and the second protruding rollers 53 may protrude to some extent from the outer circumferential surfaces of the feeding rollers 36, or the outer circumferential surfaces of the first protruding rollers 52 and the second protruding rollers 53 may not protrude from the outer circumferential surfaces of the feeding rollers 36. The switching of the first protruding rollers 52 and the second protruding rollers 53 between the forward position and the evacuation position can be performed, for example, by an actuator such as the solenoid 55 (see FIG. 9) that switches the position of the third driven roller 39. In such a case, when a leading edge of a paper sheet has not reached the transport roller pair 42 and the paper sheet is actively transported by the feeding rollers 36, the controller 56 (see FIG. 9) can position the first protruding rollers 52 and the second protruding rollers 53 to the evacuation position to ensure a contact region for the paper sheet and the feeding rollers 36. When the leading edge of a paper sheet has reached the transport roller pair 42, the controller 56 can switch the first protruding rollers 52 and the second protruding rollers 53 to the forward position to prevent a contact between the paper sheet and the feeding rollers 36.

Figure 12:
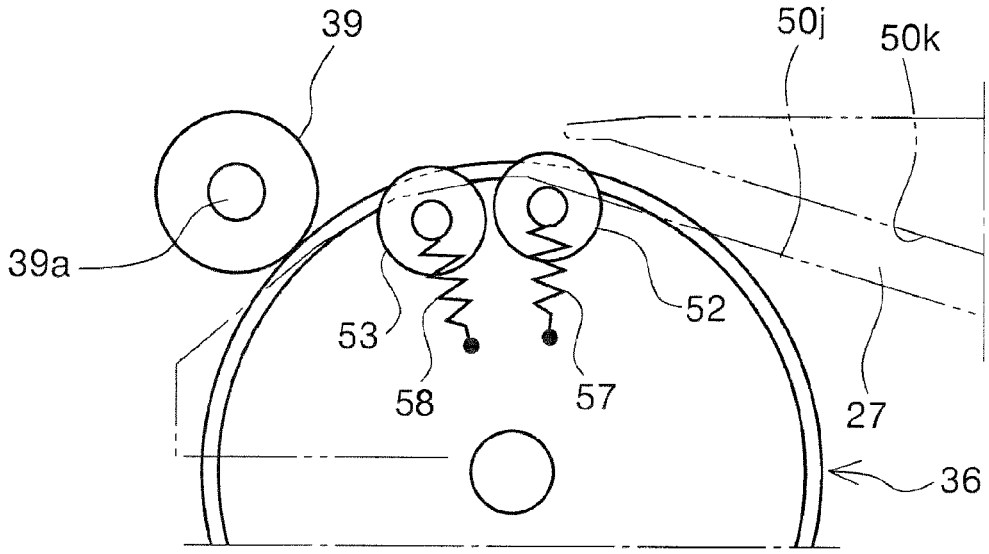
FIG. 12 illustrates protruding members according to another embodiment.

Alternatively, instead of switching the positions of the first protruding rollers 52 and the second protruding rollers 53 by the actuator, for example, the first protruding rollers 52 and the second protruding rollers 53 may be pressed toward the forward position by a pressing member such as a spring such that the protrusion amount of the first protruding rollers 52 and the second protruding rollers 53 from the outer circumferential surfaces of the feeding rollers 36 against the pressure become small. FIG. 12 illustrates an embodiment of such a case, in which a compression spring 57 is an example pressing member for pressing the first protruding roller 52 and a compression spring 58 is an example pressing member for pressing the second protruding roller 53. In this structure, when excessive tension is applied to a paper sheet and the paper sheet strongly presses against the first protruding rollers 52 and the second protruding rollers 53, the first protruding rollers 52 and the second protruding rollers 53 can retract, and thereby damages to the paper sheet by the first protruding rollers 52 and the second protruding rollers 53 can be prevented or reduced. In particular, this structure is suitable when a paper sheet is on the feeding rollers 36 and the reversing rollers 34 and is nipped by the feeding rollers 36 and the third driven roller 39 and nipped by the reversing rollers 34 and the second driven roller 38.

Figure 13:
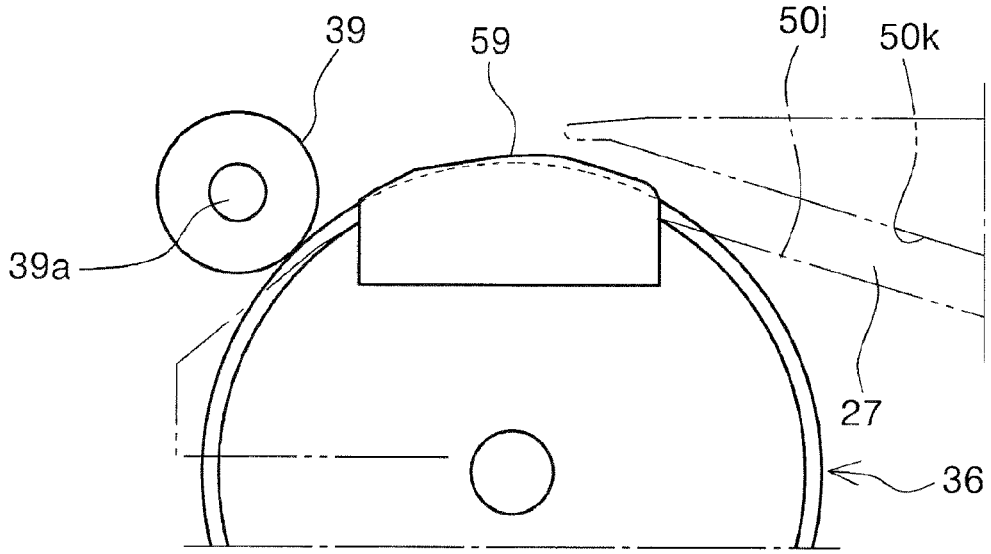
FIG. 13 illustrates protruding members according to yet another embodiment.

In the above-described embodiment, the protruding members that protrude from the outer circumferential surface of the feeding roller 36 are the driven rollers, but the protruding members may be a rib 59 that protrudes from the outer circumferential surface of the feeding roller 36 as illustrated in FIG. 13. With this structure, the protruding member can be provided in the simple structure at low cost.

The feeding roller 36 has a roller body **36*b* around a rotation shaft 36*a*, and has a high-friction member 36*c* on the outer periphery of the roller body 36*b*. The rotation shaft 36*a* may be, for example, a metal shaft and the roller body 36*b* may be made of a resin material. The high-friction member 36*c* may be made of a rubber material, for example, an ethylene propylene diene terpolymer (EPDM). Similarly, the reversing roller 34 has a roller body 34*b* around a rotation shaft 34*a*, and includes a high-friction member 34*c* on the outer periphery of the roller body 34*b*. The rotation shaft 34*a* may be, for example, a metal shaft and the roller body 34*b* may be made of a resin material. The high-friction member 34*c* may be made of a rubber material, for example, an EPDM. The first driven roller 37, the second driven roller 38, the third driven roller 39, the fourth driven roller 40, the fifth driven roller 41, the first protruding roller 52, and the second protruding roller 53** may be made of a resin material, for example, polyoxymethylene (POM).

It is to be understood that the present disclosure is not limited to the above-described embodiments, various modifications can be made within the scope of the following claims, and these modifications are included within the scope of the present disclosure.

What is claimed is:

1. A medium transport apparatus comprising:

a first roller configured to apply feeding force to a medium in a medium transport path for transporting the medium;

a second roller disposed on an upstream side of the first roller in a medium transport direction in the medium transport path, the second roller being configured to apply feeding force to the medium;

a third roller configured to be switched between a first position at which the medium is to be nipped with the second roller and a second position at which the nipping of the medium is to be released;

a switching section configured to switch a position of the third roller; and at least one protruding member protruding upward from an opening in the outer circumferential surface of the second roller, the protruding member being configured to separate the medium from the outer circumferential surface of the second roller in the medium transport path.

2. The medium transport apparatus according to claim 1, wherein the protruding member protrudes from the outer circumferential surface of the second roller on an upstream side of the nip position at which the medium is nipped by the second roller and the third roller in the medium transport direction in the medium transport path.

3. The medium transport apparatus according to claim 1, wherein the protruding member configured to a driven roller configured to contact with the transported medium and rotate, and an outer circumferential surface of the driven roller protrudes from the outer circumferential surface of the second roller.

4. The medium transport apparatus according to claim 1, wherein the at least one protruding member comprises a plurality of protruding members disposed in a width direction that is a direction intersecting the medium transport direction.

5. The medium transport apparatus according to claim 4, wherein at least some of the protruding members are disposed on both sides of the second roller in the width direction.

6. The medium transport apparatus according to claim 1, wherein the medium transport apparatus includes a fourth roller disposed on an upstream side of the second roller in the medium transport path, the fourth roller being configured to reverse the medium.

7. The medium transport apparatus according to claim 6, wherein the protruding member protrudes further from the second roller than a common tangent between an outer periphery of the second roller and an outer periphery of the fourth roller.

8. The medium transport apparatus according to claim 1, wherein the protruding member configured to a rib protruding from the outer circumferential surface of the second roller.

9. The medium transport apparatus according to claim 1, wherein the protruding member is configured to be switched between a forward position at which the protruding member protrudes from the outer circumferential surface of the second roller and a evacuation position at which the amount of protrusion of the second roller from the outer circumferential surface of the second roller is smaller than that at the forward position.

10. The medium transport apparatus according to claim 9, wherein the protruding member is pressed in a direction protruding from the outer circumferential surface of the second roller, and the protruding member is configured to be moved against the pressure in a direction the protrusion amount becomes small.

11. The medium transport apparatus according to claim 1, wherein the at least one protruding member comprises a plurality of protruding members along the medium transport path.

12. The medium transport apparatus according to claim 1, further comprising:

a path forming member configured to form the medium transport path on an upstream side of the second roller, wherein the at least one protruding member is configured to regulate the contact of the medium to the path forming member.

13. A recording apparatus comprising:

a recording section configured to perform recording onto a medium; and the medium transport apparatuses configured to transport the medium to the recording section according to claim 1.

* * * * *